US007946425B2

(12) United States Patent
Hayes Burnett

(10) Patent No.: US 7,946,425 B2
(45) Date of Patent: May 24, 2011

(54) REFRIGERATED COSMETICS BAG

(76) Inventor: Joyce Diana Hayes Burnett, Mission Viejo, CA (US)

( * ) Notice: Subject to any disclaimer, the term of this patent is extended or adjusted under 35 U.S.C. 154(b) by 855 days.

(21) Appl. No.: 11/830,301

(22) Filed: Jul. 30, 2007

(65) Prior Publication Data

US 2009/0032153 A1 Feb. 5, 2009

(51) Int. Cl.
*A45C 15/00* (2006.01)

(52) U.S. Cl. ..... 206/581; 206/557; 206/564; 206/565; 190/110; 150/113

(58) Field of Classification Search ..... 206/581, 206/557, 564, 565; 190/109, 110; 150/113
See application file for complete search history.

(56) References Cited

U.S. PATENT DOCUMENTS 299,812 A * 6/1884 Lazarus ..... 190/3
1,206,276 A * 11/1916 Wallach ..... 190/109
3,352,391 A * 11/1967 Vaughan ..... 190/111
4,717,024 A * 1/1988 Djezovic ..... 206/581
5,323,924 A * 6/1994 Wolff ..... 220/23.87
5,873,467 A * 2/1999 Willhite et al. ..... 206/581
5,941,255 A * 8/1999 Chen ..... 132/315
6,189,698 B1 * 2/2001 Asser ..... 206/581
2002/0096185 A1 * 7/2002 Givens ..... 132/287

* cited by examiner

*Primary Examiner* — Tri M Mai
(74) *Attorney, Agent, or Firm* — Eric Hanscom; Todd J. Langford

(57) ABSTRACT

This invention is directed toward an airtight, refrigerated cosmetics handbag that can be used as a stand alone product or inserted into other, larger handbags. The handbag has a pocket in the top panel into which frozen gel packs can be inserted, so that heat-sensitive cosmetics are cooled from the top. The exterior of the handbag is constructed of heat-shielding and/or heat reflective materials. The inside of the handbag additionally comprises means by which the cosmetics can be retained in a safe but compact form, and, optionally, a bi-directionally modifiable valve through which excess air can be removed subsequent to the cosmetics being placed in the handbag. The handbag can be manufactured in a variety of sizes and shapes, and, preferentially, from recycled materials.

12 Claims, 7 Drawing Sheets

REFRIGERATED COSMETICS BAG

CROSS REFERENCE TO RELATED APPLICATIONS

None.

STATEMENT REGARDING FEDERALLY SPONSORED RESEARCH OR DEVELOPMENT

This invention was not federally sponsored.

BACKGROUND OF THE INVENTION

1. Field of the Invention

This invention relates to general field of handbags and refrigerated devices relying upon removable cold packs to provide the refrigeration, and more specifically, to the field of refrigerated cosmetics bags. This invention provides an air-tight, refrigerated cosmetics handbag that can be used as a stand alone product or inserted into other, larger handbags. The handbag is used to protect cosmetics from heat degradation while the cosmetics are being transported and temporary stored The handbag has a pocket located in its top panel into which frozen gel packs can be inserted, so that the cosmetics are cooled from the top down. The lining of the pocket(s) may consist of nylon or any other material that will retain moisture and keep moisture from the refrigerated source from the cosmetics with little or no moisture escaping the shell in which the cold pack is held. The outer material of the pockets will be made of the same material and, optionally, there can be additional pockets on the inside of the handbag to hold heat sensitive cosmetics The exterior of the handbag is constructed of heat-shielding and/or heat reflective materials. A preferred embodiment calls for thick, tightly woven blended textiles that are made from knitted/blended natural or man-made fibers. The middle layer serves the purpose of insulating the inner materials from outside heat. It is preferably made from a high quality insulating material, such as insulated foam or neoprene. The inside of the handbag additionally comprises means by which the cosmetics can be retained in a safe but compact form, and a bi-directionally modifiable valve through which excess air can be removed subsequent to the cosmetics being placed in the handbag. A preferred embodiment of the handbag has elastic bands affixed to the inside surface of the handbag at intervals convenient for the storage of common cosmetic items. The handbag can be manufactured in a variety of sizes and shapes.

2. History of the Invention

Applying some form to color to the lips has been a practice known since early Egyptian times. Lipstick as we know it today is a combination of colors, waxes, and oils. The waxes in lipstick, such as beeswax, carnauba and candelilla waxes provide the shape and make lipstick easy to apply. The oils and fats help the lipstick to maintain its moisture, and are usually a mixture of olive oil, mineral oil, castor oil, cocoa butter, lanolin, and petrolatum. Lipstick may also have additional additives such as moisturizers, sunscreens, scents, vitamin E, aloe vera, collagen, and amino acids.

The process by which lipstick is made is noteworthy with respect to the refrigeration provided by this invention. The various components of lipstick are finely ground, then heated to a melting temperature and poured into cold metal molds where the individual lipsticks are allowed to cool and harden. The cooled, formed lipstick is flashed with a flame for less than a second to burn off any minor surface burrs or other imperfections, and to create a smooth and glossy finish.

Since lipsticks, along with many other types of cosmetic products, are essentially cooled liquids, it is logical that when these cosmetics are exposed to heat again, that they tend to soften, crack, and may even begin to revert to their liquid phase. Such heat degradation is obviously undesirable, as the solid shape and form of many cosmetics is essential for their successful application to a person's face.

Many women carry a variety of lipsticks and other heat-sensitive cosmetics, such as lotions and creams, mascara, lip pencil, lip gloss, eye liner, eye shadows, in their purses. During the warm seasons, daytime temperatures often exceed 100 degrees, and should a women leave her cosmetics in her car, the temperature can skyrocket well above 100 degrees very rapidly.

Thus, there is a need for a means by which cosmetics can be kept at a cool temperature.

The prior has several examples of attempts to resolve this problem. For example, refrigerated cases which are basically mini-refrigerators are known. These refrigerated cases may run off batteries, a vehicle's electrical system, or rely upon frozen cold packs to provide adequate cooling to the cosmetics. These systems are inadequate, however, when a woman wants to carry her cosmetics with her for an extended period of time—as she cannot carry a mini-refrigerator along with her—and many of these types of systems have problems with the relatively short life span of the refrigerant.

According, the need can be further focused on a portable handbag for heat-sensitive cosmetics and, indeed, heat-sensitive products of all kinds, which can contain a portable refrigerant and cosmetics, and stores the cosmetics such that they receive adequate cooling and are not damaged during transportation. It is further desirable that the handbag provide cooling from all sides, such that the cosmetics are uniformly cooled. It is particularly desirable that at least some cooling is provided from the top panel of the handbag, as cool air falls, such that the tops of any cosmetics arranged in a handbag in a "top up" manner have a constant stream of cool air descending upon them.

An additional feature that is needed is that the handbag be usable as a stand-alone products—that is, it is attractive enough to be used as a handbag, and yet be small enough so that it fits in an average sized woman's purse if such is desired. Finally, as the cooling capacity of a refrigerant is directly proportional to the amount of airspace it needs to cool, the handbag should have a means by which excess air is removed from the handbag.

The prior art contains a number of handbag and carrying bags that have one or more pockets into which portable refrigerant packs can be inserted. For example, U.S. Pat. No. 4,892,226 to Abtahi discloses a refrigerated cosmetics case, and while the case itself is not designed to be a very attractive design, the patent does discuss using two cold packs which are removable and re-freezable along the sides of the cosmetic case. This invention, however, do not provide for cooling from the top panel.

U.S. Pat. Nos. 5,237,838 and 5,361,603 to Merritt-Munson focus on creating a small airspace to be cooled, but fails to provide for cooling from the top panel and creates the small airspace through folding rather than a bi-directionally modifiable valve which can reversibly allow all the excess air in the handbag to be expelled.

U.S. Pat. No. 6,742,354 to Guinn, U.S. Pat. No. 6,729,144 to Kupferman and U.S. Pat. No. 6,742,354 to Watts provide cooling materials on various combinations of the sides and the bottom but fails to address the fact that cool air falls, and thus a cooling panel on the top of the handbag will provide for a more thorough and even cooling of the cosmetics. These patents also do not address how to effectively minimize the air space in a carrying device through means beyond simple organization and compression.

Thus there has existed a long-felt need for a portable handbag for heat-sensitive cosmetics and other heat-sensitive products, where the sides, bottom, and particularly the top panel of the handbag has means to contain a portable refrigerant and are designed to keep cool air in and reflect heat back outside of the handbag. The interior of the handbag needs to have means by which the cosmetics are stored and protected such that the cosmetics receive adequate cooling and are not damaged during transportation. There is also a need for a handbag that is manufactured in an attractive shape and design such that it can be used alone, but small and compact enough to be inserted into a larger purse. In addition, there is a need for means by which the amount of airspace in the handbag can be reversibly reduced, such that the refrigerant is not spread out cooling unnecessary air rather than being directed to cooling only the cosmetics.

The current invention provides just such a solution by having a portable handbag for heat-sensitive cosmetics and, indeed, heat-sensitive products of all kinds, which can contain one or more pockets for a portable refrigerant and straps and other means of compactly retaining cosmetics, and stores the cosmetics such that they receive adequate cooling and are not damaged during transportation. While refrigerate gel packs which can be frozen or cooled in a refrigerator or freezer are preferred, it is understood that a variety of cooling devices could be used in this invention. Any compartmentalized substance capable of being cooled or frozen, with the capacity to release cooling radiation over a prolonged period of time that could fit inside of the pockets would suffice for use with this invention.

It is also anticipated that some forms of refrigerated gel packs could be inserted into the pocket and recharged through an electrical connection to an A/C outlet or solar energy conversion device, such that the gel packs need not be removed from the pocket to be cooled or frozen again. Another embodiment of the invention provides for a small, rechargeable battery to be located in the top compartment, where the battery can recharge the gel packs, such that the gel packs can be more or less permanently stored in the pocket.

The handbag provides cooling from the refrigerant in the top panel, which provides cool air which descends down upon the tops of any cosmetics stored in an upright manner, such that the tops have a constant stream of cool air descending upon them. The location of the frozen gel pack or other refrigerant in the top panel allows for even cooling with less weight than is required by similar bags which have gel packs on several sides and the bottom. The composition of the bag is such that cool air from the refrigerated packs is directed onto the cosmetics by reflective surfaces on the interior of the handbag and, more specifically, into the pocket itself, and hot air is reflected back out by reflective materials built into the exterior surface of the bag. The positioning of at least one of the cooling packs in the top compartment of the bag allows for maximizing the cooling capacity of the bag without adding additional weight to it, as refrigerant packs on the sides and, especially, the bottom of the bag provide substantially less cooling that does one in the top of the bag, due to the fact the cooling from a refrigerated pack in the top can operate by both convective cooling and radiative cooling, while refrigerated packs on the sides and bottom can operate only through radiative cooling.

The actual top, sides, and bottom of the handbag comprise a layered series of material beginning with an outer surface of heat and light reflective material, ending on the inside with one or more pockets for refrigerant made of a temperature insulating material, such as neoprene, with a micro-fiber insulation layer in the middle. While a preferred embodiment of the bag has only one refrigerated pack in the top panel of the bag, it is contemplated that cooling packs could be arranged on one or more sides, and even the bottom of the bag as well. While a larger number of refrigerated cooling packs could add extra cooling to the bag, they would do so at the cost of additional weight, and since this bag is intended to be lightweight, it is anticipated that having a sole pack in the upper panel will suffice for the cosmetic transportation and protection needs of most women. A very thin metallic sheet optionally is placed on the inner surface of the handbag.

The outer layer of the handbag consists of thick tightly woven, blended textiles that are made of knitted/blended natural or man-made fibers. Recycled (and recyclable) materials are particularly preferred. It is contemplated that the recycled materials could come from recycled paper, plastic or various types of cloth and other commonly used clothing materials such as leather.

The next layer is an insulating layer which can be made of varying thicknesses of insulated materials such as insulated foam, neoprene or any other material that would provide and insulative barrier between the interior of the handbag and any external heat source.

Inside of the insulating layer are one or more pockets in which the refrigerating materials are stored. The lining of the pockets to hold cold pack preferably consists of nylon or another similar material that will hold moisture to separate the cold packs from the cosmetics; keeping cold air contained with the frozen gel pack with little or no moisture escaping the shell in which the cold pack is held. The outer material of the pocket can be made of same material. There can also be a pocket attached to the interior lining of the handbag in which heat-sensitive cosmetics can be held. This pocket can also be made from nylon or another material which is relatively waterproof. Cosmetics can be held firmly in place by elastic bands specifically made to hold typical shapes and sizes of common cosmetics.

The general shape of a preferred embodiment of the invention is of a compact, rectangular case, with two zippers: one between the top panel and the first layer (for heat-sensitive cosmetics); the second zipper to allow access to the second layer, which houses cosmetics that are not sensitive to the heat.

In another preferred embodiment, there is only one zipper and a removable panel separates the heat-sensitive cosmetics from the non-heat-sensitive cosmetics. The removable panel can be attached through zippers, hook and loop fasteners, snaps, magnets, or any other known means of attachment.

An additional feature that is needed is that the handbag is usable as a stand-alone product—that is, it is attractive enough to be used as a handbag, and yet be small enough so that it fits in an average sized woman's purse if such is desired. Finally, as the cooling capacity of a refrigerant is directly proportional to the amount of airspace it needs to cool, the handbag should have a means by which excess air is removed from the handbag.

An additional embodiment of the invention provides a bi-directionally modifiable valve and air-proof bladder surrounding the heat-sensitive cosmetics are provided in a particularly preferred embodiment where excess air can be expelled from the bag by merely opening the valve and pushing down on the top of the bag. This minimizes the amount of "dead air space" inside the bladder such that the cooling radiating from the refrigerated pack in the top panel of the bag is directed onto the heat-sensitive cosmetics and not dissipated by unnecessarily heating air.

SUMMARY OF THE INVENTION

It is a primary object of the invention to provide a handbag in which cosmetics can be stored and transported with a cool microclimate existing inside of the handbag.

Additional objects of the invention include:

Providing a handbag which has an attractive design and appearance such that it can be worn as a stand-alone item, and yet is small and compact enough to fit in a standard woman's purse.

Providing one or more pockets for refrigerant(s) on the top panel of the handbag. Providing means to secure the cosmetics in the interior of the handbag in a manner such that they receive adequate cooling and are not damaged during transportation.

Providing a handbag with interior walls which reflect the cool radiation from the refrigerated packs onto the cosmetics and exterior walls which reflect heat back away from the handbag.

Providing a means to remove excess air from the interior of the handbag and keep outside air from reentering the handbag until the user of the invention desires to open the handbag.

Providing separate compartments for heat-sensitive and non-heat-sensitive cosmetics, such that the cold from the frozen gel packs or other refrigerant is not "wasted" on the non-heat-sensitive cosmetics.

Providing a means by which the refrigerated portion of the handbag can be separated from the non-refrigerated portion of the handbag by a tray, upon which heat-sensitive and/or non-heat sensitive cosmetics and cosmetic supplies can be stored.

It is a final object of this invention that the handbag be relatively inexpensive to manufacture and use existing cold packs and other types of refrigerants.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DETAILED DESCRIPTION OF THE FIGURES

Figure 1:
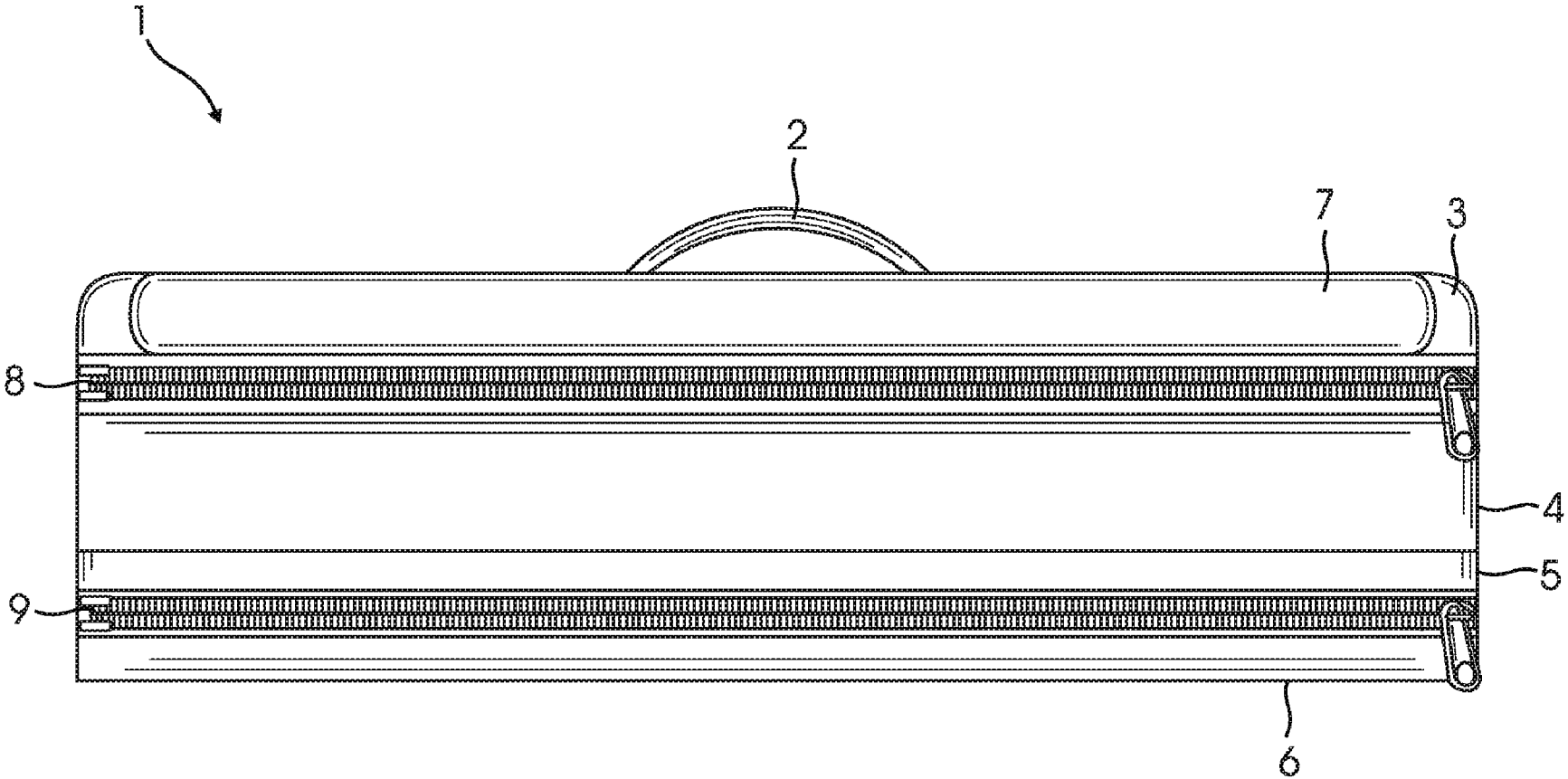
FIG. 1 is a side view of one embodiment of the invention showing the location of the refrigerated cooling pack in the top panel of the bag and the two zippers which can be used to access the top panel and refrigerated section, and the non-refrigerated section.

FIG. 1 is a side view of one embodiment of the invention showing the location of the refrigerated cooling pack in the top panel of the bag and the two zippers which can be used to access the top panel and refrigerated section, and the non-refrigerated section. The bag, generally indicated by reference number 1, has a carrying handle 2, a top 3, a first layer 4, which is for heat-sensitive cosmetics, and a second layer 5, which is for non-heat-sensitive cosmetics. To create a bag with a cavity in the center for the storage of cosmetics and associated tools, the bag is formed roughly of a top panel, one or more side panels, and a bottom panel. The side panel can be one in number, as in the case of a circular bag, three in number as in the case of a triangular bag, four in number in the case of a square or rectangular bag, five in number in the case of a pentagonal bag, etc. The top 3 has an internal compartment 7 into which a refrigerated cooling pack can be removably inserted. As discussed previously, the refrigerated cooling pack can be a frozen or cooled gel pack, a pack containing any other material that can be cooled or frozen and can emit over time cooling rays, or a cooling device which can be recharged through removable connection to an A/C source, a source of solar power, or a battery, where the battery can either be stored inside the pocket or temporarily connected to the cooling pack. There is a first zipper 8 which allows for the top 3 to be unzipped from the first layer 4. This lets a user of the invention insert or exchange cold packs from the internal compartment 7 in the top 3. It also allows access to the heat-sensitive cosmetics in the first layer 4. A second zipper 9 allows for the unzipping of the second layer 5, in which one or two trays of cosmetics which are not heat-sensitive can be stored. A preferred embodiment has one layer of non-heat-sensitive cosmetics and cosmetic supplies lying on the bottom 6 of the bag. Another embodiment has a tray attached to the top of the second layer and another tray resting lying on the bottom 6 of the bag, such that a user has access to both trays upon unzipping the second layer.

It is also contemplated that the means by which the various compartments of the bag can be accessed could include means of removable attachment in addition to zippers, such as snaps, hook and loop fasteners, magnetic snaps, leather, string, or mere folds.

The material from which the carrying handle and exterior of the bag is made can vary considerably, is it is the interior design that provides the inventive step. At the same time, one of the commercial advantages of this bag is that it looks small and stylish, as opposed to some of the prior art which resembles bulky camera bags more than stylish cosmetic bags.

Figure 2:
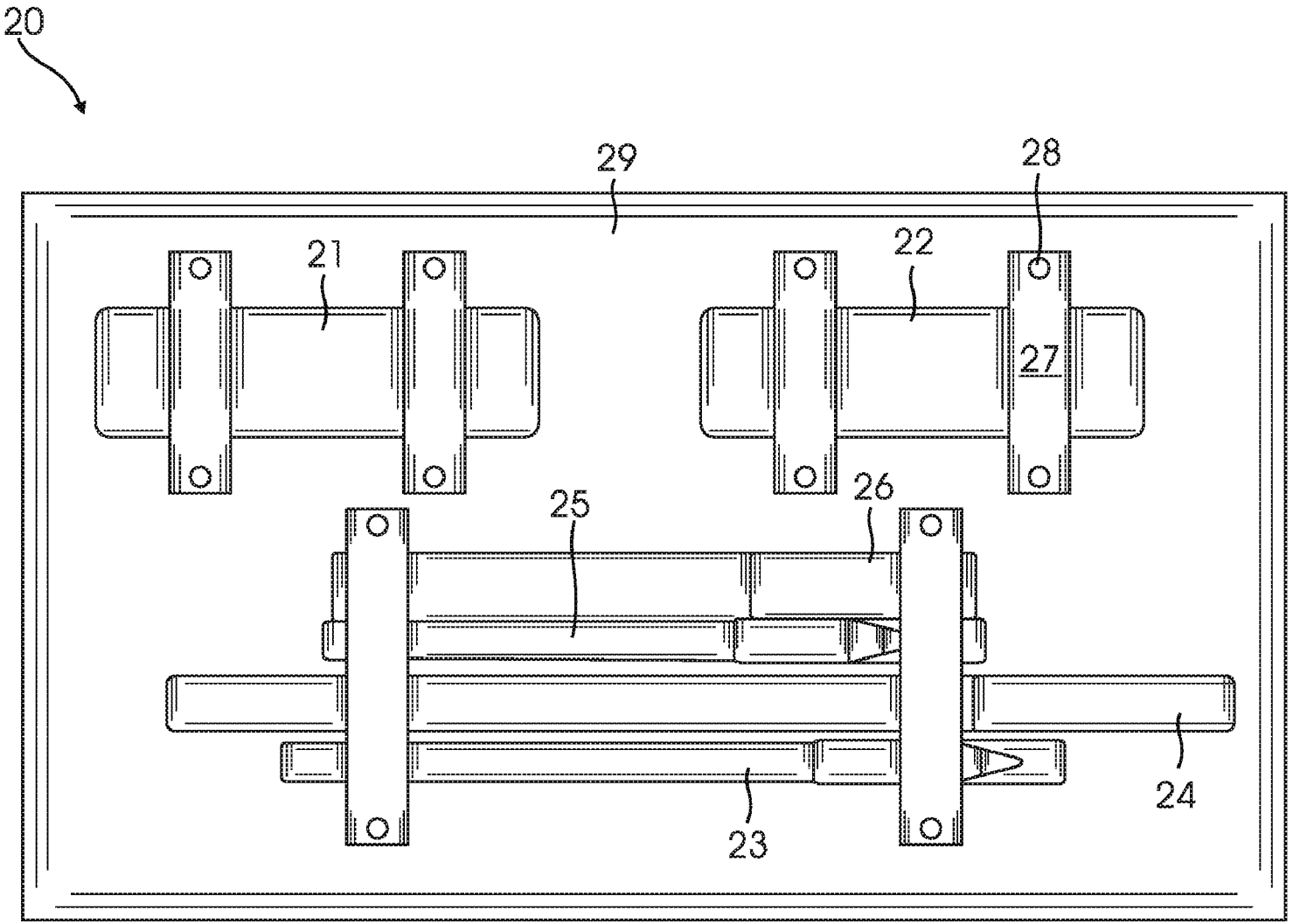
FIG. 2 is a top view of the upper side of the tray, intended for heat-sensitive cosmetics.

FIG. 2 is a top view of the tray, intended for heat-sensitive cosmetics. The tray, in a preferred embodiment, is attached to the bag in between the first layer and the second layer. The upper surface of the tray, generally referenced by 20, has a number of items of heat-sensitive cosmetics which are secured to the tray with fastening devices. In this embodiment, the fastening devices are retaining bands 17 with means of attachment 28 between the ends of the retaining bands 17 and the surface 29 of the upper tray. It is envisioned that elastic bands would work particularly well as retaining bands, and that snaps, small rivets, or other known means of attachment would suffice to attach, optionally removably, the ends of the retaining bands to the upper surface of the tray.

On the upper surface of the tray are a variety of heat-sensitive cosmetics, shown here by way of example lipsticks (21 and 22), eyeliner (23), lip liner (24), eyebrow pencil (25) and lip gloss (26).

Figure 3:
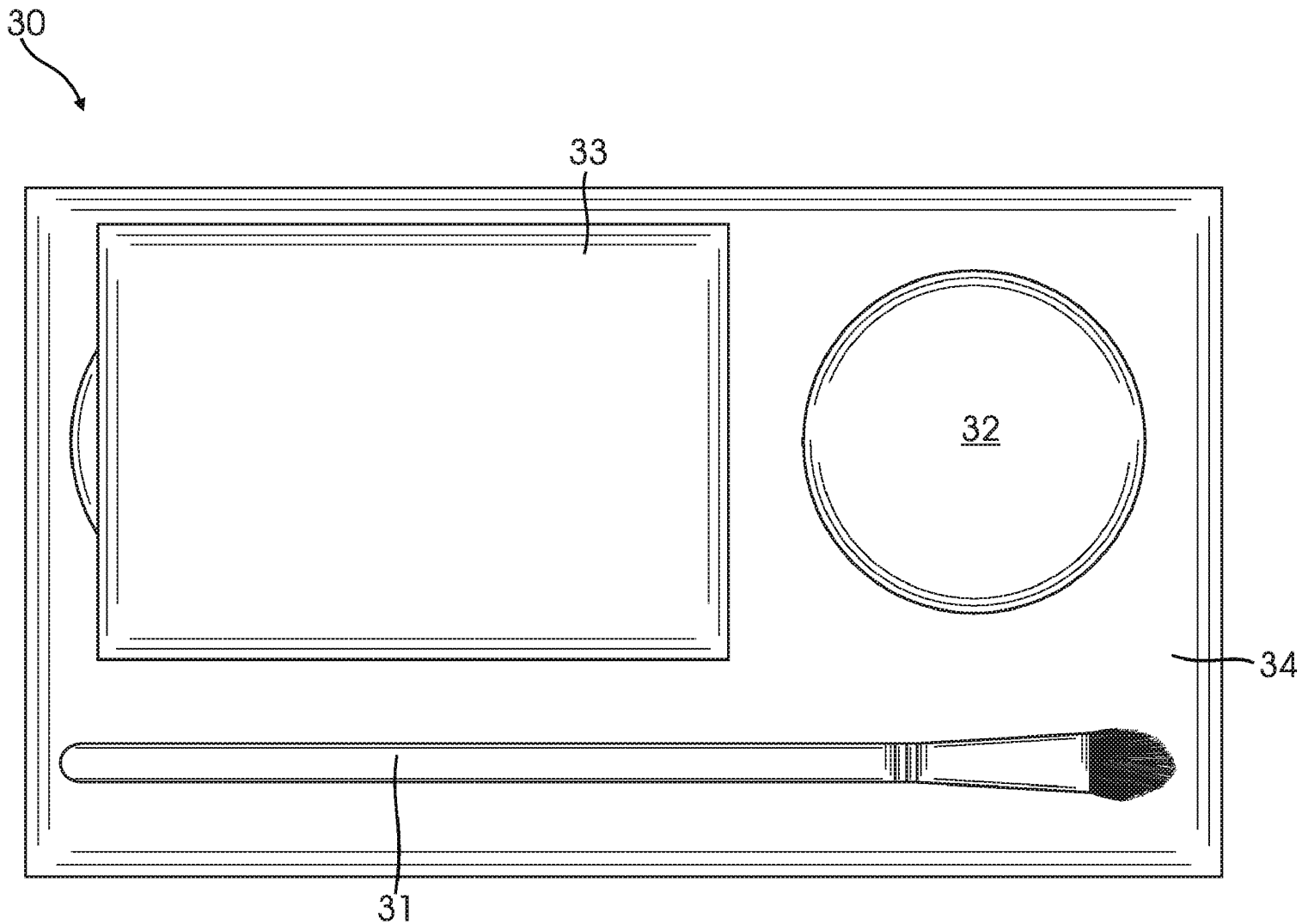
FIG. 3 is a top view of the lower side of the tray, intended for cosmetic supplies not sensitive to heat.

FIG. 3 is a bottom view of the tray, showing the bottom surface of the tray, intended for cosmetic supplies not sensitive to heat. A variety of non-heat-sensitive cosmetics, including a Make-up brush (31), #32 Eye shadow-container (32), Face powder container (33), are arrayed on the bottom surface 34 of the tray. While these non-heat sensitive cosmetics and cosmetic supplies are used for purposes of illustration, they are not intending to be limiting, as there is a virtual cornucopia of non-heat sensitive cosmetics that would be used with this invention in its various embodiments. Because the lower surface of the tray is separated from the first layer (4 in FIG. 1), it is not cooled by the refrigerated gel pack. It is also contemplate that two lower trays could be provided, with one lower tray attached to the section of the second layer above the second zipper (9 in FIG. 1), and another lower tray resting on or attached to the bottom of the bag.

Figure 4:
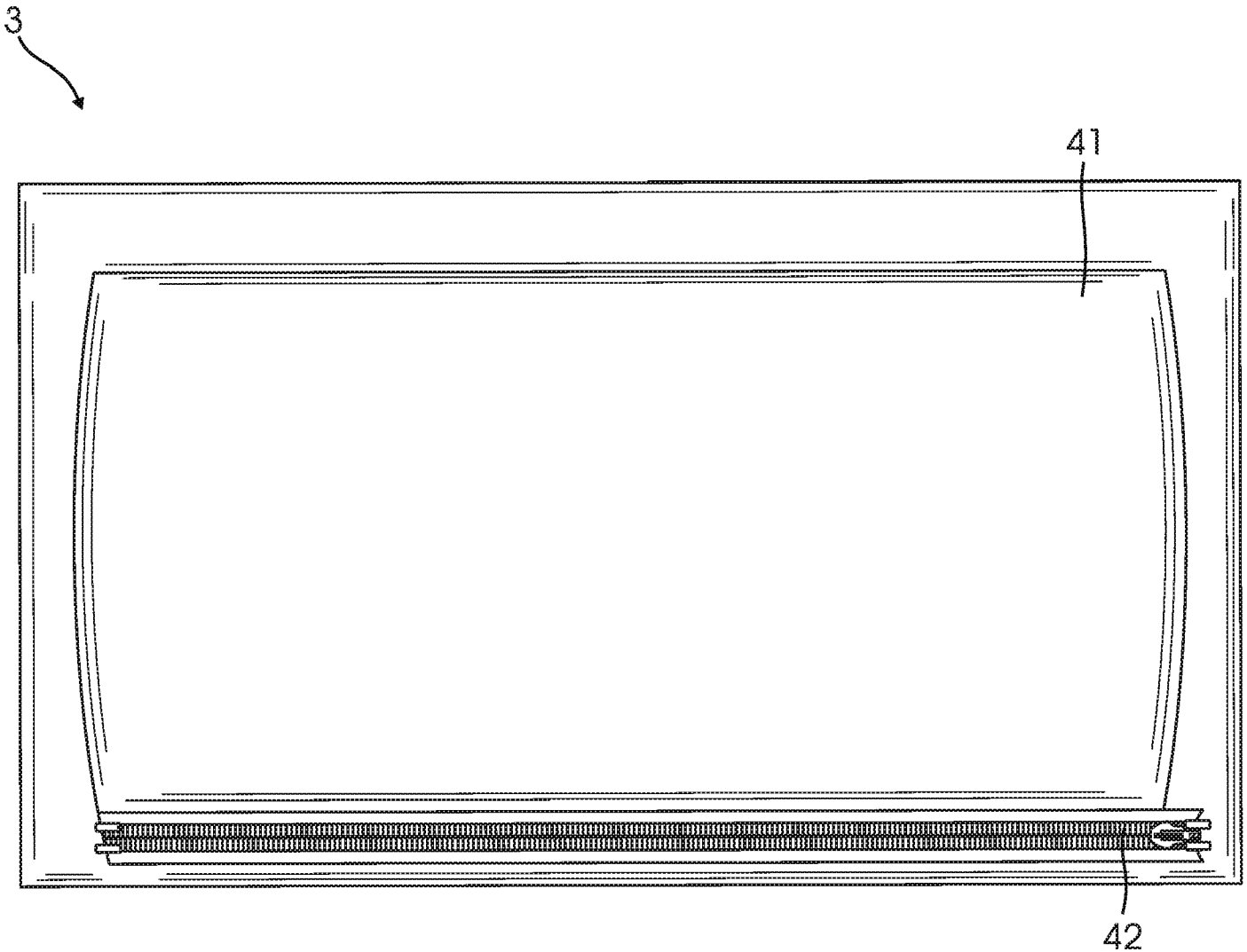
FIG. 4 is a bottom view of the top panel of the bag, showing the zippered sleeve which holds the refrigerated pack.

FIG. 4 is a bottom view of the top panel of the bag, showing the zippered sleeve which holds the refrigerated pack. The top panel of the bag, generally referred to by reference number 3, has an internal compartment 41 into which a refrigerated pack can be removably inserted. The means of allowing removable insertion in this embodiment is a zipper 42, although hook and loop, snaps and other known means of temporarily closing a pocket to removably secure and object inside are also contemplated. By positioning the source of cooling above the heat-sensitive cosmetics, the invention more efficiently directs the cooling vapors toward their intended goal and do the prior art versions which have the cooling packs on the sides and bottom.

Figure 5:
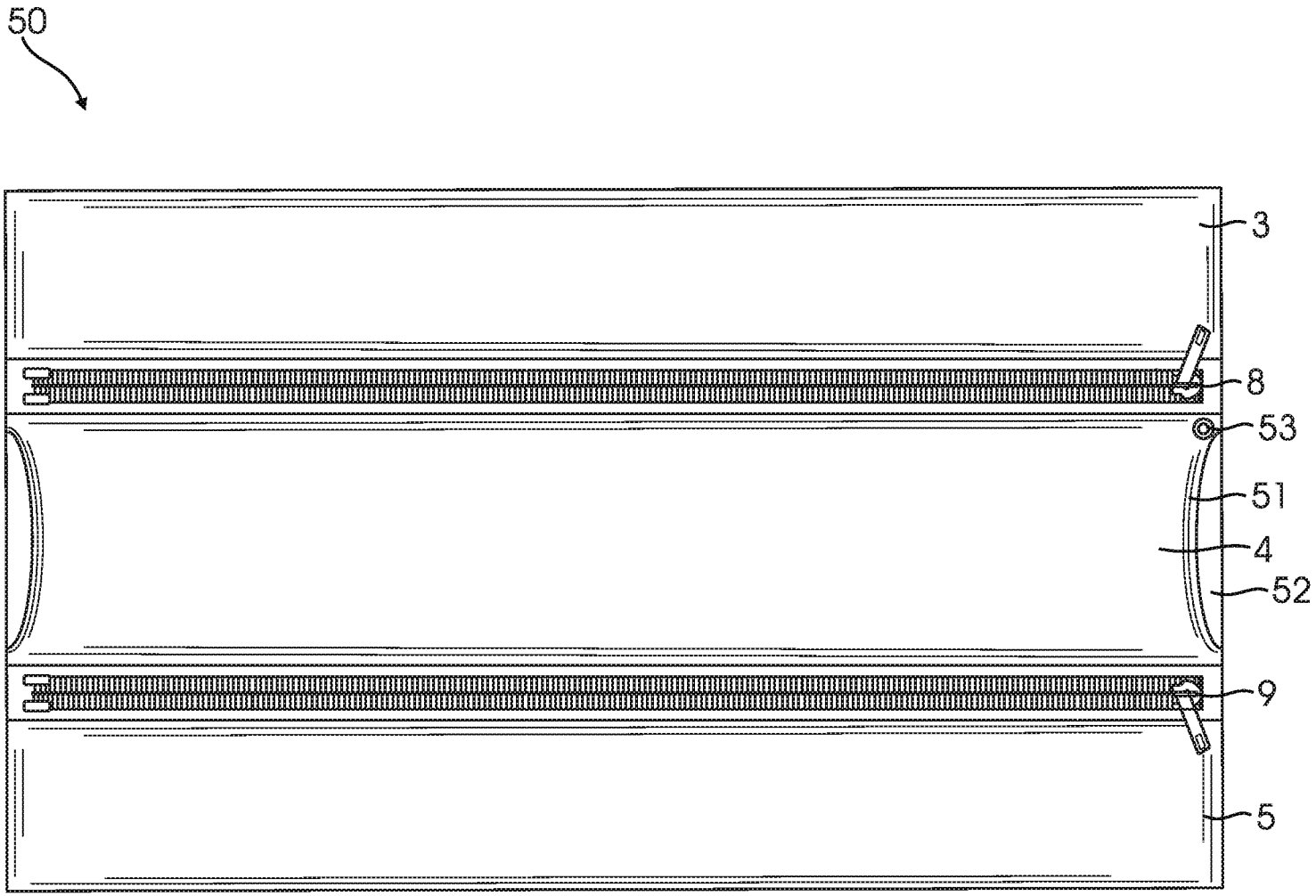
FIG. 5 is a side view of another embodiment of the invention, where the heat-sensitive section also has a bladder and bi-directionally modifiable valve which allow a user of the invention to selectively evacuate the heat-sensitive region of the bag of excess air.

FIG. 5 is a side view of another embodiment of the invention, where the heat-sensitive section also has a bladder and bi-directionally modifiable valve which allow a user of the invention to selectively evacuate the heat-sensitive region of the bag of excess air. In this embodiment, the bag is still divided into a top 3, a first layer 4 and a second layer 5 by a first zipper 8 and a second zipper 9. The top 3 still contains the internal compartment for the refrigerated gel pack (not shown in this figure), but the first layer additionally comprises a bladder 51 and a bi-directionally modifiable valve 53. The bladder is an airtight membrane that is attached to all four sides of the bag in the first layer, at the tops and bottoms of all four sides, and across the top and bottom of the first layer 4. The bladder is airtight, and has an airtight access panel across its top side, such that a user of the invention can open up the bladder to gain access to the heat-sensitive cosmetics stored therein. The airtight access panel is made from a material that allows the cold from the refrigerated pack to penetrate, which the sides and bottom of the bladder are lines with a reflective material which reflects the cold back onto the heat-sensitive cosmetics. The panel can be sealed by any known means of maintaining an airtight seal, and a particularly preferred embodiment calls for a "zip top" mechanism such as is found in many commercially popular sandwich bags. This embodiment also has a bi-directionally modifiable valve, which is a small, inconspicuous, bi-directionally modifiable valve which allows a user of the invention to press excess air out of the interior of the bladder, then seal the interior of the bladder by inactivating the bi-directionally modifiable valve. As air is evacuated, air pockets 52 on the sides of the bag enlarge such that the bag maintains its normal shape. By removing excess air, the cooling of the refrigerated pack is concentrated upon keeping the heat-sensitive cosmetics cooled, rather than having the cold dissipated between the cosmetics and the surrounding air. Once the user of the invention wishes to access her cosmetics, she merely activate the bi-directionally modifiable valve to let air in, opens the airtight access panel, and uses her cosmetics. After using, she seals the airtight access panel, expels the excess air by gently pushing on the top of the bag, and then seals the bladder by inactivating the bi-directionally modifiable valve.

Figure 6:
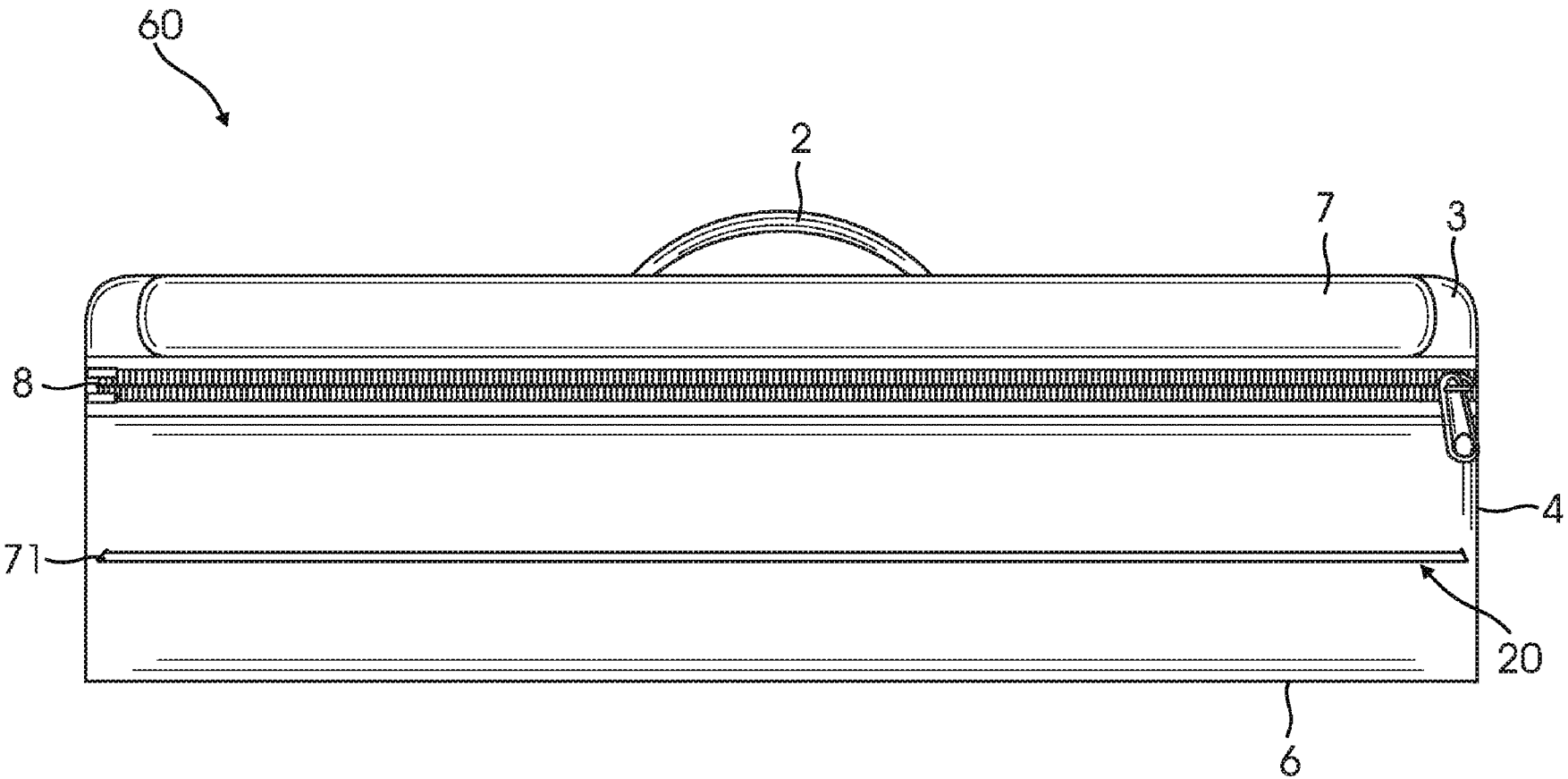
FIG. 6 is a side view of showing the bag with only one zipper which can be used to access the top panel and open up the bottom section which houses the refrigerated section, separated from the non-refrigerated section by a panel.

FIG. 6 is a side view of showing the bag with only one zipper which can be used to access the top panel and open up the bottom section which houses the refrigerated section, separated from the non-refrigerated section by a panel. In this embodiment, the parts are the same as with the "two zipper" version illustrated by FIG. 1, but the interior design is different. In the one zipper version, the zipper allows access to the refrigerated compartment in the upper panel, and allows a user to either remove refrigerated cosmetics from the upper surface of the tray (20), or to remove the entire upper tray to access the non-heat-sensitive cosmetics located on the lower surface below the tray. The tray (20) is attached to the side of the bag through means of attachment (71) which can be snaps, zippers, hook and loop, or any other known means of attachment.

Figure 7:
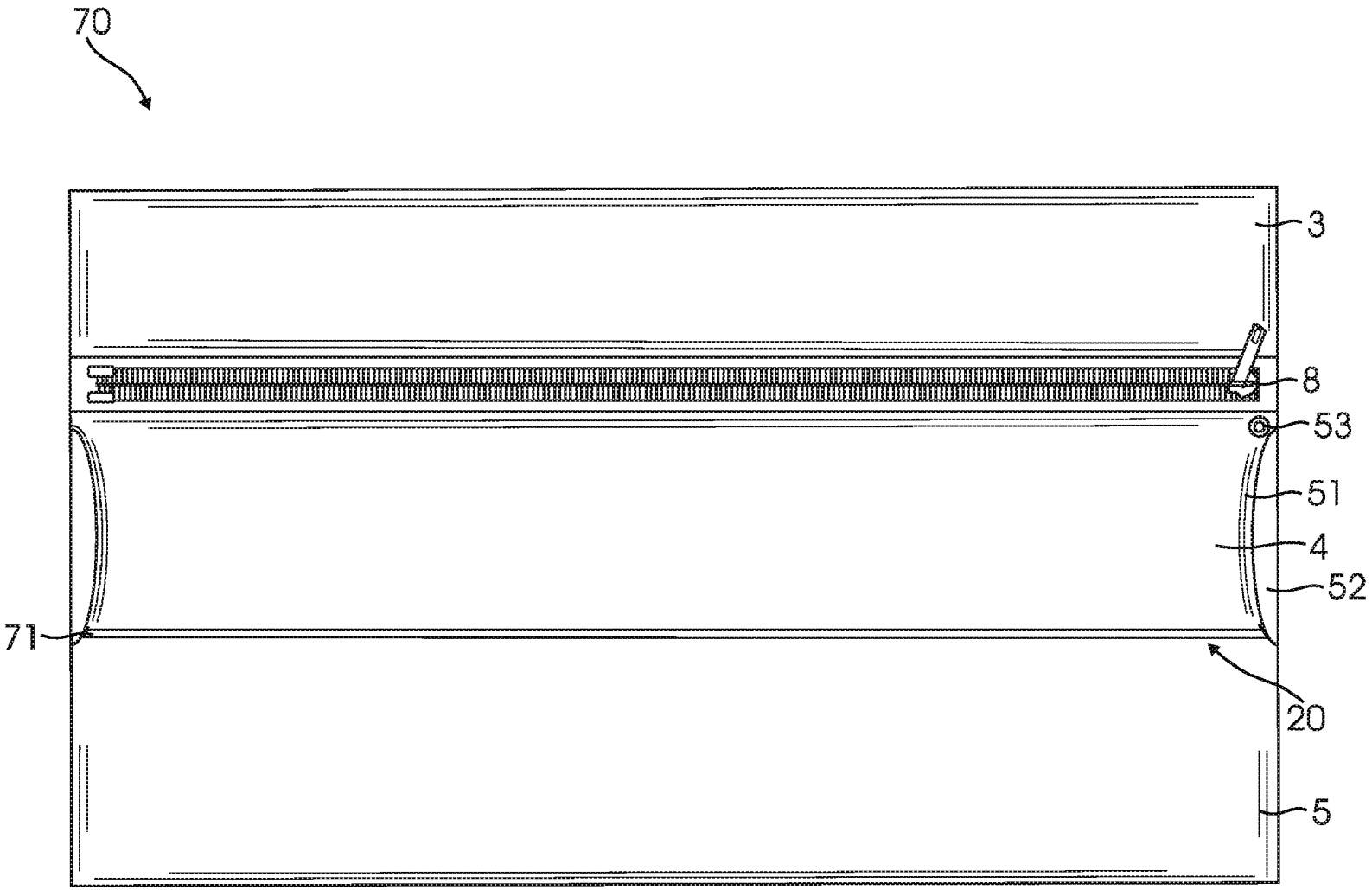
FIG. 7 is a side view of another embodiment of the invention where one zipper allows access to the entire bag, and where there is a bladder which focuses the refrigerant's cooling upon the heat-sensitive cosmetics.

FIG. 7 is a side view of another embodiment of the invention where one zipper allows access to the entire bag, and where there is a bladder which focuses the refrigerant's cooling upon the heat-sensitive cosmetics. The tray (20) is attached in this illustration to the lower section of the bladder (51), thereby allowing a user of the invention to compress the bag and expel all the excess air from the bladder, thereby removing "dead air" from the heat-sensitive cosmetics so that they will stay cooler. The tray (20) can be detached from the bladder (51) to allow access to the non-heat-sensitive cosmetics stored on the underside of the tray (20). In another embodiment, the tray (20) is attached to the side of the bag, and the lower portion of the bladder (51) also attaches to the side of the bag.

I claim:

1. A handbag for heat-sensitive products, comprising:

a container with a top panel, at least one side panel, and a bottom panel, where each panel has at least one edge, where the bottom panel and side panels are connected to one another at the edges of each panel, where each of the top panel, bottom panel and side panels has an interior side and an exterior side, where the exterior sides of all the panels are constructed of a material that reflects heat, where the top panel has located on its interior side at least one pocket with means to open and close the pocket, where the at least one pocket is capable of receiving a frozen gel pack or other refrigerant, and means to open the top panel to install or replace a frozen gel pack or other refrigerant, and additionally comprising a first compartmental section which is located directly under the top panel, and where the first compartmental section has a tray, where the tray has an upper surface and a lower surface, and additionally has at least one item of heat-sensitive cosmetics attached to the top of the tray and at least one item of non-heat-sensitive cosmetic supplies attached to the lower surface of the tray, where the upper surface of the tray is made from a material capable of reflecting cold back into the first compartmental section, such that cold from the frozen gel pack or other refrigerant is substantially limited to the first compartmental section, and additionally comprising a first zipper, where the first zipper is located between the top panel and the first compartmental section, and where the first zipper allows for a user of the invention to access the at least one pocket in the top panel and the tray.

2. The handbag of claim 1, additionally comprising restriction means to restrict the movement of the contents of the handbag when the handbag is moved.

3. The handbag of claim 2, where the restriction means is one or more elastic bands, where the one or more elastic bands have two end portions and a central portion, disposed along the interior side of the side panel with means at attaching the end portions to a tray.

4. The handbag of claim 1, additionally comprising protection means to protect the contents of the handbag when the handbag is moved.

5. The handbag of claim 4, where the protection means consist of one or more elastic bands which have two end portions and a central portion, disposed along the interior side of one or more side panels with means at attaching the end portions to a tray, where by securing one or more items of cosmetics to a tray, the one or more items of cosmetics are protected from jostling into other items of cosmetics when the handbag is moved.

6. The handbag of claim 1, additionally comprising a second compartmental section and a second zipper, where the second compartmental section is located directly under the first compartmental section, and where the second compartmental section has at least one lower tray, where each of the at least one lower trays has at least one item of non-heat-sensitive cosmetics attached to it, and where the first compartmental section and the second compartmental section are separated from each other by a layer of material that has an upper surface which forms a bottom of the first compartmental section, and where the second zipper is located between the first compartmental section and the second compartmental section, and where the second zipper allows for a user of the invention to access the at least one lower tray.

7. A handbag for heat-sensitive products, consisting of: a container with a top panel, at least one side panel, and a bottom panel, where each panel has at least one edge, where the bottom panel and side panels are connected to one another at the edges of each panel, where each of the top panel, bottom panel and side panels has an interior side and an exterior side, where the exterior sides of all the panels are constructed of a material that reflects heat, where the top panel has located on its interior side at least one pocket with means to open and close the pocket, where the at least one pocket is capable of receiving a frozen gel pack or other refrigerant, and means to open the top panel to install or replace a frozen gel pack or other refrigerant, and additionally comprising a first compartmental section which is located directly under the top panel, and where the first compartmental section has an upper tray, where the upper tray has at least one item of heat-sensitive cosmetics attached to it, a second compartmental section which is located directly under the first compartmental section, and where the second compartmental section has at least one lower tray, where each of the at least one lower trays has at least one item of non-heat-sensitive cosmetics attached to it, and where the first compartmental section and the second compartmental section are separated from each other by a layer of material that has an upper surface which forms a bottom of the first compartmental section, where the upper surface has a characteristic of reflecting cold back into the first compartmental section, such that cold from the frozen gel pack or other refrigerant is substantially limited to the first compartmental section, and additionally comprising a first zipper and a second zipper, where the first zipper is located between the top panel and the first compartmental section, and where the first zipper allows for a user of the invention to access the at least one pocket in the top panel and the upper tray, and where the second zipper is located between the first compartmental section and the second compartmental section, and where the second zipper allows for a user of the invention to access the at least one lower tray.

8. The handbag of claim 6, additionally comprising compaction means to restrict the movement of the contents of the handbag when the handbag is moved, where the compaction means is one or more elastic bands, where the one or more elastic bands have two end portions and a central portion, disposed along the interior side of the side panel with means at attaching the end portions to a tray.

9. The handbag of claim 6, additionally comprising protection means to protect the contents of the handbag when the handbag is moved, where the protection means consist of one or more elastic bands which have two end portions and a central portion, disposed along the interior side of the side panel with means at attaching the end portions to a tray, where by securing one or more items of cosmetics to a tray, the one or more items of cosmetics are protected from jostling into other items of cosmetics when the handbag is moved.

10. A method of protecting heat-sensitive cosmetics, comprising the steps of first, obtaining a handbag for heat-sensitive products, comprising: a container with a top panel, at least one side panel, and a bottom panel, where each panel has at least one edge, where the bottom panel and side panels are connected to one another at the edges of each panel, where each of the top panel, bottom panel and side panels has an interior side and an exterior side, where the exterior sides of all the panels are constructed of a material that reflects heat, where the top panel has located on its interior side at least one pocket with means to open and close the pocket, where the at least one pocket is capable of receiving a frozen gel pack or other refrigerant, and means to open the top panel to install or replace a frozen gel pack or other refrigerant, and additionally comprising a first compartmental section which is located directly under the top panel, and where the first compartmental section has a an upper tray, where the upper tray has at least one item of heat-sensitive cosmetics attached to it, a second compartmental section which is located directly under the first compartmental section, and where the second compartmental section has at least one lower tray, where each of the at least one lower trays has at least one item of non-heat- sensitive cosmetics attached to it, and where the first compartmental section and the second compartmental section are separated from each other by a layer of material that has an upper surface which forms a bottom of the first compartmental section, where the upper surface has a characteristic of reflecting cold back into the first compartmental section, such that cold from the frozen gel pack or other refrigerant is substantially limited to the upper layer, and additionally comprising a first zipper and a second zipper, where the first zipper is located between the top panel and the first compartmental section, and where the first zipper allows for a user of the invention to access the at least one pocket in the top panel and the upper tray, and where the second zipper is located between the first compartmental section and the second compartmental section, and where the second zipper allows for a user of the invention to access the at least one lower tray, second, inserting a frozen gel pack or other refrigerant into the at least one pocket in the top panel, third, inserting at least one item of heat-sensitive cosmetics into the upper tray, fourth, replacing the frozen gel pack or other refrigerant as needed.

11. The method of claim 10, where the handbag additionally comprises compaction means to restrict the movement of the contents of the handbag when the handbag is moved, where the compaction means is one or more elastic bands, where the one or more elastic bands have two end portions and a central portion, disposed along the interior side of the side panel with means at attaching the end portions to a tray, and additionally comprises protection means to protect the contents of the handbag when the handbag is moved, where the protection means consist of one or more elastic bands which have two end portions and a central portion, disposed along the interior side of the side panel with means at attaching the end portions to a tray, where by securing one or more items of cosmetics to a tray, the one or more items of cosmetics are protected from jostling into other items of cosmetics when the handbag is moved.

12. The method of claim 11, where the handbag is constructed from recycled materials.

* * * * *